United States Patent [19]

Bayley

[11] 4,264,700

[45] Apr. 28, 1981

[54] METHOD OF FORMING MAGNETIC TONER PARTICLES HAVING A CONCENTRATION OF MAGNETIC PARTICLES GREATER THAN 45 PERCENT BY WEIGHT BY DISPERSION POLYMERIZATION TECHNIQUES

[75] Inventor: Robert D. Bayley, Ontario, N.Y.

[73] Assignee: Xerox Corporation, Stamford, Conn.

[21] Appl. No.: 88,237

[22] Filed: Oct. 22, 1979

[51] Int. Cl.[3] ..... G03G 9/00

[52] U.S. Cl. ..... 430/137; 430/107; 260/42.14; 260/42.53; 427/218; 427/219; 427/221

[58] Field of Search ..... 430/137, 107, 109; 260/42.14, 42.53; 427/218, 219, 221

[56] References Cited

U.S. PATENT DOCUMENTS

| | | | |
|---|---|---|---|
| 3,634,251 | 1/1972 | Maeda et al. | 430/137 |
| 3,893,933 | 7/1975 | Brown | 430/137 |
| 3,959,153 | 5/1976 | Sadamatsu et al. | 430/137 |
| 4,071,670 | 1/1978 | Vanzo et al. | 526/88 |
| 4,077,804 | 3/1978 | Vanzo | 430/107 |
| 4,097,620 | 6/1978 | Lu | 427/127 |
| 4,148,741 | 4/1979 | Bayley | 430/137 |

OTHER PUBLICATIONS

Condensed Chemical Dictionary, pp. 866–867.

*Primary Examiner*—Mary F. Downey

[57] ABSTRACT

Toner particles are prepared by a dispersion polymerization technique wherein a solvent for the monomer is included in the preparation of the discontinuous phase, and the solvent is removed prior to polymerization to increase the weight ratio of the magnetic particles present in the completed toner particles.

9 Claims, No Drawings

METHOD OF FORMING MAGNETIC TONER PARTICLES HAVING A CONCENTRATION OF MAGNETIC PARTICLES GREATER THAN 45 PERCENT BY WEIGHT BY DISPERSION POLYMERIZATION TECHNIQUES

BACKGROUND OF THE INVENTION

This invention relates to a method of preparing magnetic toner particles by dispersion polymerization methods and more particularly to a method of preparing toner particles having a concentration of magnetic material greater than 45 percent by weight by dispersion polymerization methods.

Magnetic toner particles have recently found application in the development of electrostatographic images as single component developers. Single component magnetic developers are particularly applicable in small copiers where size constraints are an important aspect. In some applications, the toner particles are field dependent, that is they are capable of acting as conductors under high electrical fields and capable of acting as insulators under low electric fields. This permits the development of the latent electrostatic image by induction and the transfer to plain paper by electrostatic techniques.

It has been learned through experimentation that the toner particles should have a concentration of magnetic particles of from about 50 to about 60 percent by weight. Toner particles with such high magnetic particle concentration can be obtained by bulk methods and by spray drying methods. In the bulk method of preparation the magnetic particles and the polymer are blended together by any suitable technique including, for example, mastication on a rubber mill, in Banbury mixers, and the like with subsequent particle size reduction of the bulk material to a suitable size for use as toner. One disadvantage of this technique is that the particle size of the toner is not uniform, thus, classification methods are required in order to achieve a toner composition of uniform particle size.

Spray drying techniques are conducted by dissolving a suitable polymer in a solvent to which is added the proper quantity of magnetic pigment. Subsequently, toner particles are formed by spray drying the solution to achieve toner size spherical particles. This technique is capable of achieving magnetic toner particles having the suitable concentration of magnetic material contained therein however it is generally a rather expensive process and has not found commercial acceptance because of this reason.

A third method of preparing toner particles has been termed the dispersion polymerization method. In this technique, the magnetic particles are first mixed with monomer together with a reaction initiator and subsequently this mixture is suspended in an aqueous medium in which the reaction takes place within each particle resulting in the formation of toner size particles which are then removed from the aqueous medium by conventional techniques. A problem that exists with this technique is that the maximum concentration of magnetic particles in the completed toner particles is from about 40 to about 45 percent by weight. This is not the optimum percentage for use in single component magnetic developing methods.

It is desirable, however, to utilize dispersion polymerization methods for the preparation of single component magnetic developer because of its low cost, narrow resulting toner particle size distribution and the reduced number of processing steps employed.

It would, therefore, be desirable to provide single component magnetic developer particles containing greater than 45 percent magnetic particles by weight by a dispersion polymerization method in order that the inherent advantages of the dispersion polymerization method can be obtained.

SUMMARY OF THE INVENTION

The invention herein is to prepare a suspension of the discontinuous phase in an aqueous or continuous phase wherein the droplets of the discontinuous phase contain a vinyl monomer, a polymerization initiator, magnetic particles and a solvent for the monomer. The continuous phase contains water and a suspension stabilizing agent. The discontinuous phase and the continuous phase are mixed in a manner to achieve toner size droplets of the discontinuous phase in the continuous phase. The solvent for the monomers is next removed from the discontinuous phase and polymerization of the monomers present in the discontinuous phase is brought about to achieve toner size particles which are subsequently recovered.

In preparation of the discontinuous phase, all of the components thereof may be mixed together in a single mixing step or the monomer may be dissolved initially in the solvent therefore and subsequently the magnetic material and the polymerization initiator added thereto. This system which makes up the discontinuous phase is then agitated in order to bring about uniform dispersion of the various components thereof. The discontinuous phase is rapidly agitated with the continuous phase by suitable techniques such as a high shear mixer including a Waring Blender equipped with a Polytron head in order to size the droplets of the discontinuous phase to that desired for the toner particles. It is preferred that the toner particles have a size of from about 5 to about 35 microns and most preferably from about 5 to about 15 microns.

As pointed out above, after the suspension of the toner sized droplets of the discontinuous phase in the continuous phase, the solvent for the monomer is removed from the discontinuous phase. This can be accomplished simply by choosing a solvent for the monomer which is soluble in water. In this case, the solvent migrates to the interface of the discontinuous phase with the continuous phase and dissolves in the water. Any solvent for the monomer having this characteristic may be employed such as, for example, methanol, ethanol, propanol, butanol, or any solvent that is soluble in both the continuous phase and the discontinuous phase. Vacuum conditions may also be employed if desired to remove the solvent.

Subsequent to the removal of the solvent from the discontinuous phase, the reaction mass is heated in order to bring about the polymerization of the monomer droplets. Upon completion of the polymerization the solid toner particles thus formed are recovered from the reaction mass by any suitable technique including filtration, decanting, centrifuging and the like.

In the preparation of the discontinuous phase, the magnetic material is utilized in an excess of at least 1.5 times the weight of the monomer employed. This is to insure that the final particles resulting from the reaction contain greater than about 45 percent by weight of magnetic material. It is preferred that the magnetic particles are used in an amount such that the resulting toner particles contain from about 50 to about 65 percent by weight.

The quantity by weight of solvent employed in the preparation of the discontinuous phase should be from about 0.1 to about two times the quantity of the monomer employed in the makeup of the discontinuous phase. The quantity of solvent employed is not critical but depends upon economic considerations and the amount of magnetic material desired in the finished product.

In the preparation of the monomer or discontinuous phase, any suitable vinyl monomer may be employed such as, for example, esters of saturated alcohols with mono and polybasic unsaturated acids, such as, alkyl acrylates and methacrylates, haloacrylates, diethyl maleate, and mixtures thereof; vinyl and vinylidene halides such as vinyl chloride; vinyl fluoride, vinylidene chloride, vinylidene fluoride, tetrafluoroethylene, chlorotrifluoroethylene and mixtures thereof; vinyl esters such as vinyl acetate, unsaturated aromatic compounds such as styrene and various alkyl styrenes, alphamethyl styrene parachlorostyrene, parabromostyrene, 2,4-dichlorostyrene, vinyl naphthalene, paramethoxystyrene and mixtures thereof; unsaturated amides such as acrylamide, methacrylamide and mixtures thereof; unsaturated nitriles such as acrylonitrile, methacrylonitrile, haloacrylonitrile, phenylacrylonitrile, vinylidene cyanide, and mixtures thereof; N-substituted unsaturated amides such as N,N dimethyl acrylamide, N-methyl acrylamide, and mixtures thereof; conjugated butadienes such as butadiene, isoprene and mixtures thereof; unsaturated ethers such as divinyl ether, diallyl ether, vinyl alkyl ether and mixtures thereof; unsaturated ketones such as divinyl ketone, vinyl alkyl ketone and mixtures thereof; unsaturated aldehydes and acetals such as acrolein and its acetals, methacrolein and its acetals, and mixtures thereof; unsaturated heterocyclic compounds such as vinyl pyridine, vinyl furan, vinyl coumarone, N-vinyl carbazole, and mixtures thereof; unsaturated alicyclic compounds such as vinyl-cyclopentane, vinyl-cyclohexane and mixtures thereof; unsaturated thio compounds such as vinyl thio-ethers; unsaturated hydrocarbons such as ethylene, propylene, coumarone, indene, terpene, polymerizable hydrocarbon fractions, isobutylene and mixtures thereof; alkyl compounds such as alkyl alcohol, allyl esters, diallyl phthalate, triallylcyanurate and mixtures thereof. Any suitable mixture of copolymerizable monomers of the type described above can also be used in the process of this invention.

In the preparation of the discontinuous or monomer phase, any suitable polymerization initiator can be used such as, for examples, azobisisobutyronitrile (AIBN), benzoyl peroxide, methylethyl ketone peroxide, isopropyl peroxy carbonate cumene hydroperoxide, 2,4-dichloryl benzoyl peroxide, lauroyl peroxide and the like. Generally, from about 0.5 to about 5 weight percent initiator based on the weight of the monomer is suitable.

Any suitable particulate material exhibiting paramagnetism, that is, capable of being attracted by a magnet, such as, for example, iron and alloys thereof, iron oxide, nickel and alloys thereof, ferrites, magnetite and the like may be used. Magnetite is the preferred material not only because of its paramagnetic properties but because of its color properties. It may be desirable to include other colorants such as dyes and pigments together with the magnetic particles in order to obtain the desired color of the finished toner particles. In order to achieve toner particles having the desired dimensions set forth above, the particle size of the magnetic particles should be from about 0.01 to about 0.5 microns and preferably from about 0.01 to about 0.2 micron.

As indicated above, the discontinuous phase is mixed into the aqueous or continuous phase under high shear and rapid agitation in order to form monomer particles having the particle size of the desired final toner particle as the discontinuous phase. The continuous phase is made up of order and a suitable stabilizing agent, such as for example, polyvinyl alcohol, gelatin, methyl cellulose, methylhydroxypropylcellulose, ethyl cellulose, sodium salt of carboxy methyl cellulose, polyacrylate acids and their salts, starch, gums, alginates, zein, casein, tricalcium phosphate, talc, barium sulfate, bentonite and the like. The stabilizing agent is present in the continuous phase in a stabilizing amount, preferably from about 0.1 to about 1 percent by weight and most preferably in an amount from about 0.1 to about 0.4 percent by weight.

Generally, sufficient continuous phase including solvent, is added to the aqueous phase to effect a volumetric ratio of continuous phase to aqueous phase ranging from about 0.05:1 to about 1:1, and preferably from about 0.1:1 to about 0.5:1. Any suitable mixing device which will bring about toner size particles in the monomer phase may be employed. Subsequent to removal of the solvent, polymerization is conducted by standard polymerization techniques. The reaction is conducted in any suitable apparatus such as a reaction kettle equipped with a stirrer.

The invention will be further illustrated by the following examples in which parts are by weight unless otherwise specified:

EXAMPLE I

About 356 parts of magnetite having a particle size of about 0.1 micron is dispersed in a Waring Blender into about 300 parts of styrene, about 21 parts of lauroyl peroxide, and about 40.8 parts of methanol. The high shear of the Waring Blender is to insure wetting and dispersing of the magnetite in the monomer. About 125 parts of this slurry is added to about 600 parts by volume of a 1 percent solution of polyvinyl alcohol in water and the system is subjected to sufficient shear to produce toner size droplets in the water continuous phase, the particles being about 15 microns in diameter. The polyvinyl alcohol is 88% hydrolyzed and has a weight average molecular weight of about 60,000. Mixing is continued for approximately 30 minutes in order to permit the methanol to migrate to the water phase and become dissolved therein. Polymerization is then conducted by heating to about 70° C. for about seven hours after which the solidified toner particles are recovered by decanting.

EXAMPLE II

The procedure of Example I is repeated except that about 50 parts of ethanol are substituted for the 40.5 parts of methanol. The resulting particles contain about 54 percent of magnetite.

EXAMPLE III

The procedure of Example I is repeated except that about 200 parts of styrene and about 100 parts of n-butyl methacrylate are substituted in place of the 300 parts of styrene. Atomic absorption indicates that the resulting particles contain 54 percent magnetite.

EXAMPLE IV

Example I is once again repeated except that about 557 parts of magnetite are employed in place of 356 parts. The resulting toner particles contain about 65 percent magnetite.

It is to be understood that various modifications will become apparent to one skilled in the art.

What is claimed is:

1. A method of making magnetic toner particles by dispersion polymerization technique which comprises forming a suspension of a discontinuous phase of toner size droplets in a continuous phase, said discontinuous phase containing a vinyl monomer, a polymerization initiator, magnetic particles and a solvent for the monomer, said continuous phase containing water and a suspension stabilizing agent, removing the solvent from the discontinuous phase, heating the monomer and recovering the thus formed toner particles.

2. The method of claim 1 wherein the quantity of magnetic particles based on the weight of vinyl monomer present in the discontinuous phase is greater than 45 percent by weight.

3. The method of claim 2 wherein the quantity of magnetic particles present is from about 50 to 65 percent by weight.

4. The method of claim 1 wherein the size of both the droplets of the discontinuous phase and the toner particles is from about 5 to about 35 microns.

5. The method of claim 1 wherein the magnetic particles are magnetite.

6. The method of claim 1 wherein the weight ratio of solvent to the monomer present in the discontinuous phase is from about 0.5:1 to about 2:1.

7. The method of claim 1 wherein the solvent for the monomer present in the discontinuous phase is soluble in water and is removed from the discontinuous phase by migration to the aqueous phase.

8. The method of claim 1 wherein the volumetric ratio of the continuous phase to aqueous phase, prior to removal of the solvent for the monomer is from about 0.05:1 to about 1:1.

9. The method of claim 8 wherein the volumetric ratio is from about 0.1:1 to about 0.5:1.

* * * * *